US008361590B2

(12) United States Patent
Chakraborty et al.

(10) Patent No.: US 8,361,590 B2
(45) Date of Patent: Jan. 29, 2013

(54) LIGHTWEIGHT STRUCTURAL COMPOSITE FOR LOAD BEARING APPLICATIONS

(75) Inventors: Bikash Chandra Chakraborty, New Delhi (IN); Manoj Nalanda Rajagopalan, New Delhi (IN); Senthil Kumar Kandhaswamy Srinivasan, New Delhi (IN); Ram Sahay Pandey, New Delhi (IN); Praveen Sreenivasan, New Delhi (IN); Uttam Gopal Suryavanshi, New Delhi (IN); Rohidas Dasharath Raut, New Delhi (IN); Arun Kumar Shah, New Delhi (IN)

(73) Assignee: Defence Research & Development Organization, New Delhi (IN)

( * ) Notice: Subject to any disclaimer, the term of this patent is extended or adjusted under 35 U.S.C. 154(b) by 878 days.

(21) Appl. No.: 11/883,154

(22) PCT Filed: Jun. 23, 2005

(86) PCT No.: PCT/IN2005/000212
§ 371 (c)(1),
(2), (4) Date: Apr. 2, 2008

(87) PCT Pub. No.: WO2006/082595
PCT Pub. Date: Aug. 10, 2006

(65) Prior Publication Data

US 2009/0123687 A1 May 14, 2009

(30) Foreign Application Priority Data

Feb. 2, 2005 (IN) ..... 206/DEL/2005

(51) Int. Cl.
*B32B 3/28* (2006.01)
*B32B 37/12* (2006.01)

(52) U.S. Cl. ..... 428/76; 428/68; 428/116; 428/542.8

(58) Field of Classification Search ..... 428/76, 428/68, 116, 542.8
See application file for complete search history.

(56) References Cited

U.S. PATENT DOCUMENTS
(Continued)

FOREIGN PATENT DOCUMENTS

| | | | |
|---|---|---|---|
| EP | 1 149 691 | | 10/2001 |
| JP | 06017493 A | * | 1/1994 |

(Continued)

OTHER PUBLICATIONS

Translation of JP 06017493 A, Fuji et al., Jan. 25, 2004.*

(Continued)

*Primary Examiner* — Brent O'Hern
(74) *Attorney, Agent, or Firm* — Ladas & Parry LLP

(57) ABSTRACT

The present invention relates to a lightweight structural composite, which comprises an inner core of lightweight panel encapsulated by outer layers of polymer material. Specifically, the lightweight panel consists of multiple laminations of corrugated thin metal or fiber reinforced plastic sheets kept in position by polymeric foam and/or adhesive, and enclosed in a casing of the same material. The outer layer is made up of a blend of thermosetting and thermoplastic polymers. The method of forming the composite comprises of stacking the corrugated sheets, filling the interstitial spaces with the foam, constructing the casing, the surface treatment of the panel for good adhesion to the outer polymer layer and the high temperature/pressure encapsulation of the panel with the polymer blend containing curing agents. The composite has application as replacement to wood, concrete or particle board panels used in ship docking, panels for wall, door and windows, blast-proof panels, rail sleepers and shipping pallets.

7 Claims, 7 Drawing Sheets

U.S. PATENT DOCUMENTS

| | | | | | |
|---|---|---|---|---|---|
| 3,629,046 | A | | 12/1971 | Gilbert | |
| 3,718,714 | A | | 2/1973 | Comstock | |
| 3,773,638 | A | * | 11/1973 | Gotoh et al. | 522/5 |
| 3,998,909 | A | | 12/1976 | Roberts et al. | |
| 4,088,723 | A | | 5/1978 | Norton | |
| 4,090,340 | A | | 5/1978 | Becker | |
| 4,265,067 | A | | 5/1981 | Palmer | |
| 4,428,993 | A | | 1/1984 | Kohn et al. | |
| 4,539,244 | A | | 9/1985 | Beggs | |
| 4,710,432 | A | * | 12/1987 | Nishimura et al. | 428/542.8 |
| 4,837,999 | A | | 6/1989 | Stayner | |
| 4,917,742 | A | | 4/1990 | Watanabe | |
| 4,925,721 | A | * | 5/1990 | Harper-Tervet et al. | 428/116 |
| 5,037,498 | A | * | 8/1991 | Umeda | 156/307.3 |
| 5,041,323 | A | | 8/1991 | Rose | |
| 5,057,176 | A | | 10/1991 | Bainbridge | |
| 5,076,176 | A | | 12/1991 | Clasen | |
| 5,338,594 | A | | 8/1994 | Wang | |
| 5,344,700 | A | | 9/1994 | McGath et al. | |
| 5,364,178 | A | | 11/1994 | Hofman | |
| 5,433,156 | A | | 7/1995 | Hutchinson | |
| 5,496,610 | A | | 3/1996 | Landi et al. | |
| 7,842,147 | B2 | | 11/2010 | Shen | |

FOREIGN PATENT DOCUMENTS

| | | |
|---|---|---|
| JP | 2002 347009 | 12/2002 |
| RU | 2186808 | 8/2002 |
| WO | WO99/55979 | 11/1999 |
| WO | 00/07784 | 2/2000 |
| WO | WO02/26455 | 4/2002 |
| WO | WO02/26456 | 4/2002 |
| WO | WO03/008494 | 1/2003 |

OTHER PUBLICATIONS

English Abstract of RU 2186808.
English Abstract of JP 2002 347009.

* cited by examiner

LIGHTWEIGHT STRUCTURAL COMPOSITE FOR LOAD BEARING APPLICATIONS

This application is a national phase of PCT International Patent Application PCT/IN2005/00212 (WO2006/082595), filed Jun. 23, 2005, which claims priority from Indian Patent Application No. 206/DEL/2005, filed Feb. 2, 2005, the contents of which are incorporated herein by reference.

FIELD OF THE INVENTION

The present invention relates to a lightweight structural composite for load bearing applications. In particular, the present invention relates to a lightweight structural composite, which comprises an inner core of lightweight panel encapsulated by outer layers of polymer material. Specifically, the lightweight panel consists of multiple laminations of corrugated thin metal or fibre reinforced plastic sheets kept in position by polymeric foam and/or adhesive, and enclosed in a casing of the same material. The outer layer is made up of a blend of thermosetting and thermoplastic polymers. The method of forming the composite comprises of stacking the corrugated sheets, filling the interstitial spaces with the foam, constructing the casing, the surface treatment of the panel for good adhesion to the outer polymer layer and the high temperature/pressure encapsulation of the panel with the polymer blend containing curing agents. The composite has application as replacement to wood, concrete or particle board panels used in ship docking, panels for wall, door and windows, blast-proof panels, rail sleepers and shipping pallets.

BACKGROUND OF THE INVENTION

It has a long been the desire of the polymer industry to provide a wood or concrete substitute which is sufficiently inexpensive and ensures a long service life. Current structural composites utilized for solid wood or pallets are particle boards covered with thermoplastic or thermosetting resins. Examples area found in many patents. For example, the patent to Rettenmair (WO 03/008494) elaborates granular filling material comprising natural cellulose fibres in synthetic thermoplastic material which is used for producing moulded bodies, while that of Shalashov (RU 2186808) describes a pressure composition for wood board fabrication based on ground wood and vegetable particles and diphenylolpropane resin. A composition for synthetic wood based on a thermoplastic resin, shredded wood and a lubricant is patented by Yasushi (JP 2002347009) whereas a composition based on high strength, high modulus fibres in uncured adhesive used for reconstituted wood product is explained in the patent to Tingley (WO 99/55979). Lipman (WO 02/12645) explains the use of elongate synthetic wood mouldings formed of a settable wood paste comprising wood flour, a binder and a solvent that is flexible or stiff under conditions of processing, A significant disadvantage, of all these materials described above, however, is their high density, low stiffness and high manufacturing costs. Another disadvantages is that these materials can not be formed to thickness higher than 50 mm. Yet another disadvantage is that these material can not be used for repeated compressive or bending stress of more than 3 Mpa. Hence, there is a need for a lightweight but stiff composite structure that has longer life and can be used repeatedly for load bearing applications. One of the many ways to improve the strength and stiffness is the use of special or corrugated structures in certain paperboards and pallets, examples of which may be found in the patent to Gilbert, U.S. Pat. No. 3,629,046 (rectangular wood frame and core consisting of a slab of polystyrene sandwiched between two sheets of corrugated cardboard); Palmer, U.S. Pat. No. 4,265,067 (foamed plastic core panel comprising an inner core of corrugated plastic foam); Stayner U.S. Pat. No. 4,837,999 (a prefabricated building panel having a center core with an inner and outer skin coupled by pultrusion); Bainbridge U.S. Pat. No. 5,057,176 (automotive headline comprising of a laminate of double corrugated paperboard); Clasen, U.S. Pat. No. 5,076,176 (a lightweight pallet composed of layered and bonded corrugated cardboard material); Hofman et al, U.S. Pat. Nos. 5,364,178 (a metal case made up of an inner framework of corrugated metal panels encased in a metal wrapper), and Hutchison, 5,422,156 (a shipping pallet constructed of multiple lamination of corrugated sheet material made up of paperboards, fiberboards or plastic). However, one of the major disadvantages of many of these items is that all these cannot be used repeatedly under compressive or bending stress of more than 3 Mpa. Another key drawback is the inability of these items to be constructed of more than 50 mm thickness.

Till date, no one has combined the various structural features and material compositions disclosed in the present so as to address and overcome problems and shortcomings associated with all of the following: weight, strength, durability, malleability, modularity, insulating quality and load bearing under compression or bending modes.

OBJECTS OF THE INVENTION

It is one of important objects of the present invention to provide a lightweight structural composite, which comprises an inner core of lightweight panel encapsulated by outer layers of polymer material.

It is another object of the present invention to provide a lightweight structural composite, which has application as replacement to wood, concrete or particle board panels used in ship docking, panels for wall, door and window, blast proof panels, rail sleepers and shipping pallets. This is especially applicable where large blocks of detect free wood or concrete are required for high compressive or blending load bearing applications.

SUMMARY OF THE INVENTION

The present invention provides an innovative process for manufacturing a lightweight structural composite, taking the advantage of corrugated structures and the encapsulating capability of polymeric materials. The process of encapsulation of the corrugated light weight structure with a high strength polymer blend and the design of the composite block is a new concept in this area. The advantages of the present innovation are lower cost and lighter weight than a fully polymeric block, better stiffness due to the special lightweight core, ease of manufacture and better vibration characteristics due to the composite nature. The structural composite under present invention has the advantages such as higher load bearing capacity under compressive and bending mode, depending on the arrangement of the corrugated sheets, ease of fabrication oven up to 100 mm thickness, capability to adopt the contour of the ship hull under compression in repeated cycles without compression set, negligible creep and environmental stability.

BRIEF DESCRIPTION OF THE ACCOMPANYING DRAWINGS

DETAILED DESCRIPTION OF THE INVENTION

Figure 1:
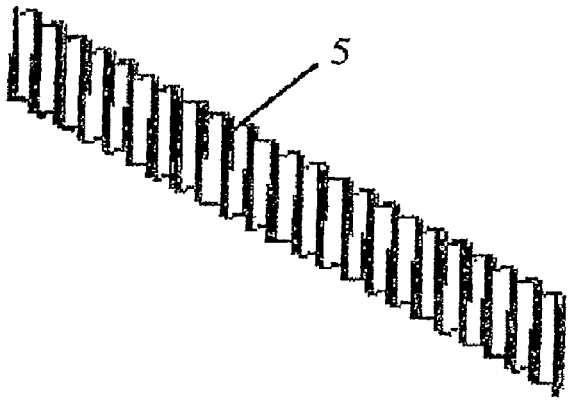
FIG. 1 is an isometric view of one of the geometry of the flute.

This invention provides a structural composite 1, which has an inner core of lightweight panel 2 encapsulated by out layers of polymer material 3. Specifically, the outer encapsulating cover 3 of the composite is made up of a blend of thermosetting and thermoplastic polymers, and the core 2 comprises a lightweight panel containing corrugated sheets of metal or FRP enclosed in a metal or FRP case.

The size of the composite structural panel can be made to any size ranging from 50 mm×50 mm×22 mm to 2000 mm×1500 mm×150 mm depending on application.

The material comprising the outer encapsulating cover is preferably a blend of polymers. In the preferred composition, the blend is a composition of a thermosetting polymer such as phenol-formaldehyde resin, melamine-formaldehyde, elastomers such as natural rubber, polychloroprene, nitrile rubber, poly (ethylene-vinyl acetate), polyurethane elastomer, styrene-butadiene rubber or vinyl resin, and a thermoplastic polymer such as polyethylene, polypropylene, poly (vinyl acetate) or poly (vinyl chloride). In the preferred combination the two polymers are combined along with a curing agent that may be cured under the application of temperature and pressure.

The inner lightweight panel 2 consists of two parts: First is a core made up of corrugated sheets 4, having selected flute specifications 5, depending of the requirement of density, strength and application. The corrugated sheets 4 are made up of metal or FRP. The flute dimensions and orientation is decided by the application requirements. For example, the corrugation may be oriented in vertical direction to the surface if compressive load application is intended, whereas the orientation may be horizontal if bending load application is proposed. The corrugated sheets 4 are stacked together to a formation of desired width. In the preferred combination, this stack is epoxy adhesive bonded and then filled with polyurethane foam to secure the pattern. A strip of predetermined length and height may be cut from this composite corrugated structure. The cut strip is then enclosed in a casing (10) of the metal or FRP sheets, the edges of which are then welded or adhesive bonded together for stability. The total structure comprising the corrugated sheets and casing constitutes the inner lightweight panel 1.

After the inner lightweight panel 2 of the desired dimension is made, its surface is treated with a chemical agent such as 4,4'-diphenylmethane diisocyanate (MDI) to improve its adhesion to the outer polymer layer. The entire assembly of the surface treated panel and the polymer blend in sheet form on all the sides of the panel is then kept in a mould and cured under the application of temperature and pressure.

The following non-limiting examples are set to illustrate the present invention.

Manufacturing Procedure

Figure 2:
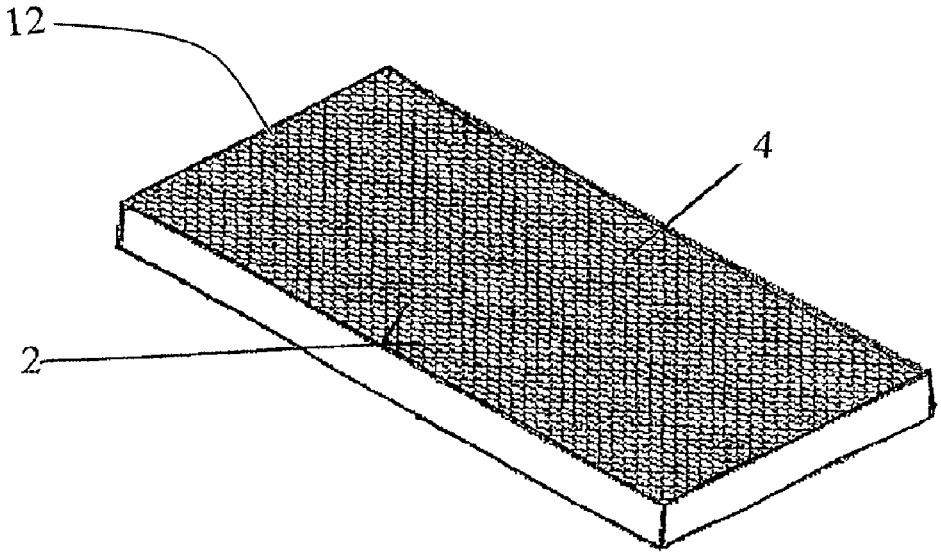
FIG. 2 is an isometric view of the panel containing the corrugated foam filled stack of sheets without the top sheets.
Figure 3:
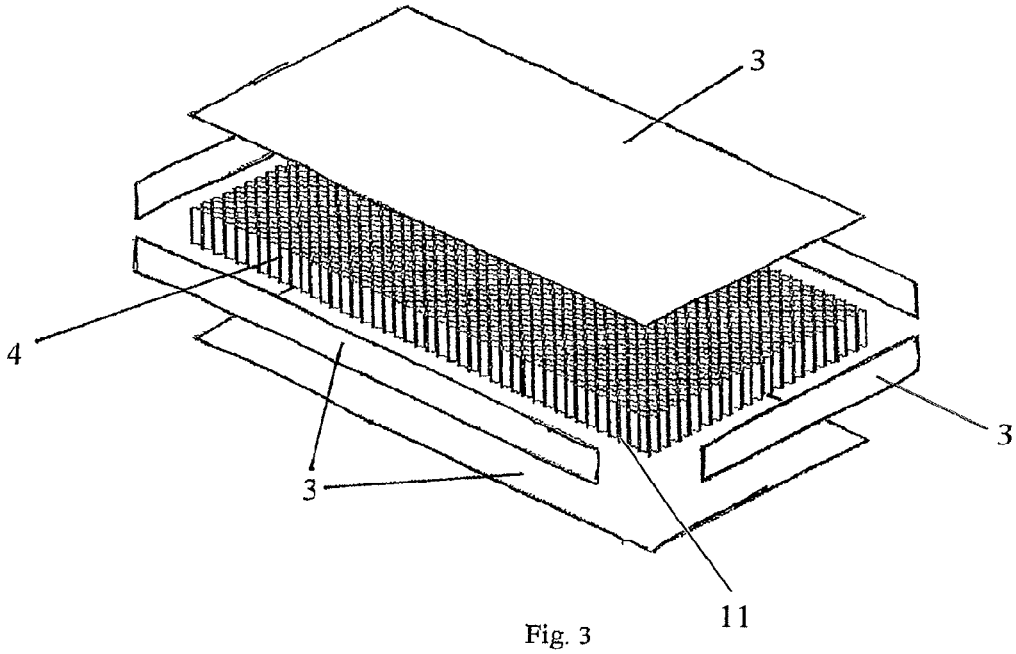
FIG. 3 is an exploded view of the panel in accordance with the invention.

The procedure described herein exemplifies one method for manufacturing a lightweight structural composite of this invention of size 1000 mm length×500 mm width×100 mm height, containing an aluminium inner panel of size varying from 800 mm length×400 mm width×25 mm height to 950 mm length×450 mm width×75 mm height depending on the final requirement of strength, density and application. The fabrication process of such a composite is described below:

With reference to FIGS. 1 and 2, the inner core 2 of corrugated sheet 4 is of aluminium. In the preferred combination, a specific density of 46 numbers of flutes 5 per meter is used. The flutes 5 of single face-single wall configuration are made by using press brake. The fluted sheets are stacked vertically to the desired size and held between clamps. They are then bonded with a commercially available epoxy adhesive (11) such as LY 556/HY951 system. After 48 hours, a polyurethane foaming mixture consisting of an isocyanate such as 4,4'-diphenylmethane diisocyanate (MDI), a polyol such as 1,4-butane diol and a catalyst such as dibutyltin dilaurate is poured in to the interstitial spaces between the flutes 5 and allowed to foam. Once the foam (12) is set in about 2 hours, the corrugated 4 structure is removed from the clamps and encased on all sides with aluminum sheets 6 of thickness 1 mm. The edges are then TIG welded. The exposed surfaces of the box is wiped with 4,4'-diphenylmethane diisocyanate (MDI), using a cotton cloth half an hour prior to encapsulation. The panel, as shown in FIG. 3, is now ready for encapsulation by the polymer.

A typical polymer blend used for the outer layer 3 consists of 28% of the thermosetting resin phenol-formaldehyde resin, 49% of the elastomer poly(acrylonitrile-butadiene) elastomer (average molecular weight 1,50,000 by HPCL). The thermoplastic and the elastomer are slowly added in the hopper of an internal mixer which is set at 170° C. with a rotational speed of 50 rpm. The rise in the torque due to shearing is observed for attainment of steady value. In no case, the torque is allowed to rise beyond 75 Nm. Changing the rotational speed ensures this. Subsequently, the mixed lump is discharged into a tray. The lump is then masticated in a two-roll mill with sequential addition of the thermosetting resin along with 0.25% stearic acid 3% zinc oxide, 1% sulphur and 0.75% mercaptobenzothiazole rubber accelator. The mixing is done for 10 minutes to achieve uniformity. The compounded mix is then sheeted out using 0.5 mm nip gap in the roll mill. The polymer blend is ready for encapsulation.

Figure 4:
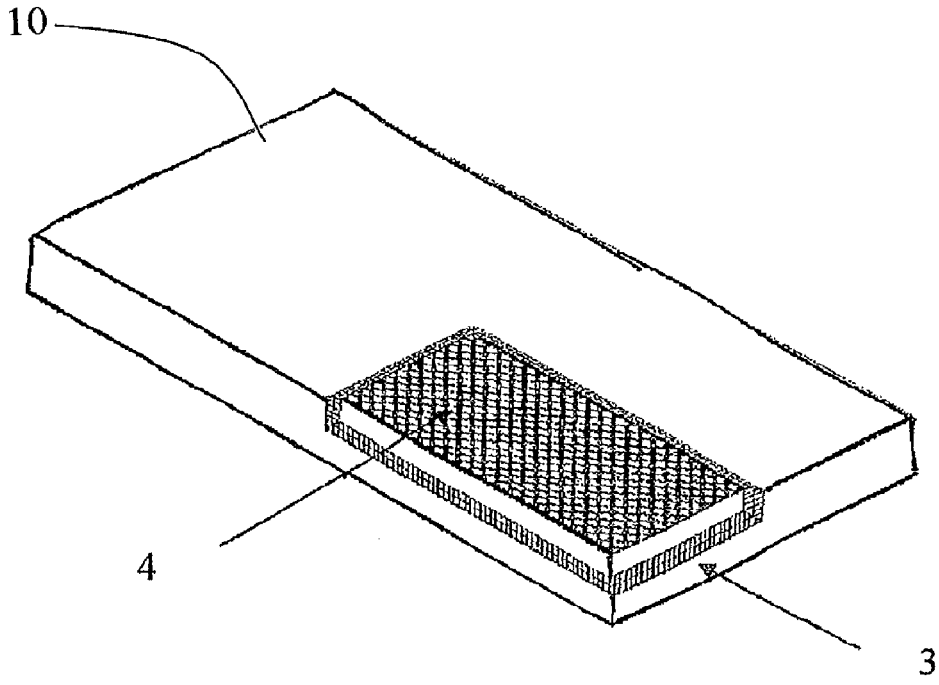
FIG. 4 is a pictorial view of light weight structural composite showing inner core of light weight panel and the outer polymer encapsulation.

A mild steel mould is used for encapsulation of the inner lightweight panel by the polymer. The top and bottom pieces of the mould are just plane sheet covers for the middle cavity, which is of the size of the final composite requirement, which in this case is of 1000 mm length×500 mm width×100 mm height. A sheet of compounded polymer is mix is first placed at the bottom of the mould, followed by the surface treated panel and a sheet of compounded polymer mix on top. The panel is aligned to be in the middle of the mould cavity and the gap between the panel and mould is packed uniformly with cut pieces of the compounded polymer mix. The mould is then covered and encapsulation done by applying a temperature of 150° C. for 40 min under the pressure of 10 Mpa in the compression moulding press preheated to the 150° C. After 40 min. pressure is released; a moulded composite as shown in FIG. 4 is removed from the mould and conditioned for 24 h prior to further use.

Test Method

Figure 5:
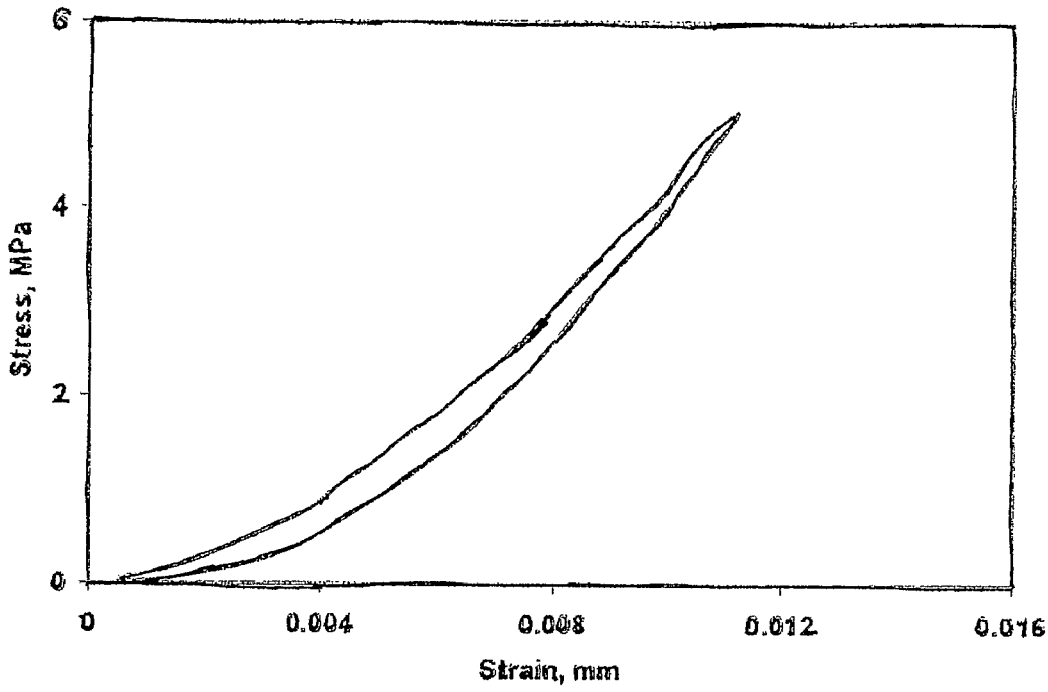
FIG. 5 is the plot of results on compression cycling.
Figure 6:
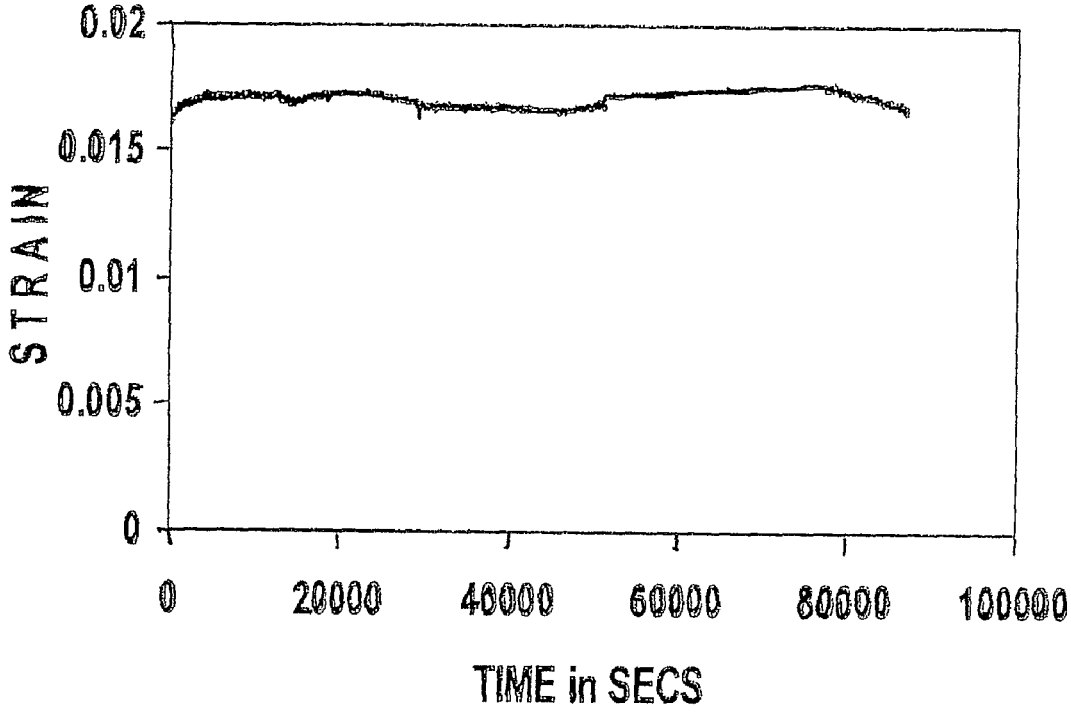
FIG. 6 is the plot of the result on Creep study of structural composite at 5 MPa compressive stress at room temperature.

The composite is characterized for compression cycling, creep and vibration attenuation. For the first two tests, a test piece of 200 mm length×50 mm width×500 mm height is used, while a sample of 200 mm length×50 mm width×12.5 mm height is utilized later. The compression cycling is carried out at 1 mm/min till the stress reaches 5 Mpa and then releasing the force. The results are shown in FIG. 5. The strain at 5 Mpa in compression is only 0.012 mm and on releasing the load, the recovery is complete. The creep tests are also carried out on the same machine by applying a stress of 5 Mpa and monitoring the strain over a period of time. The results are shown in FIG. 6. The strip is almost constant at 0.017 and change in strain with time is seen to be negligible.

It is clear from compression cycle and creep study that the structural composite has excellent stiffness and negligible creep.

Figure 7:
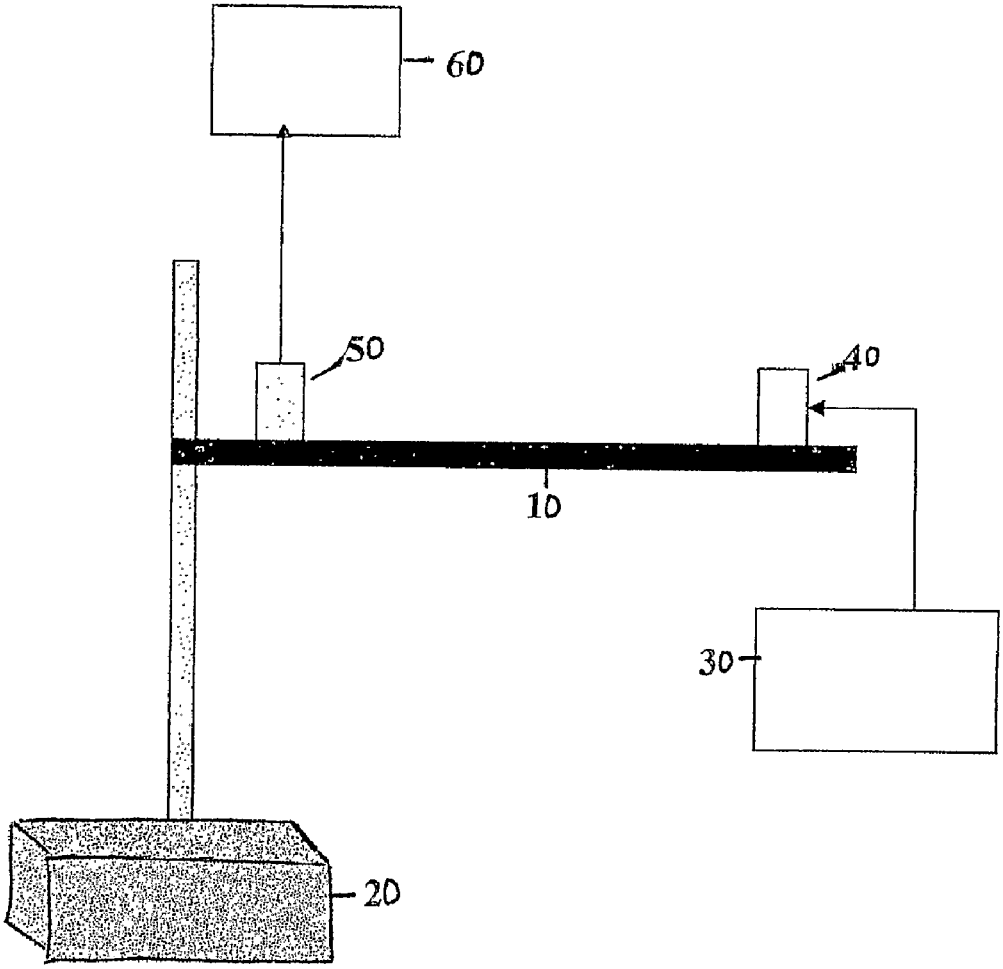
FIG. 7 is the test setup for measuring the vibration sensitivity.
Figure 8:
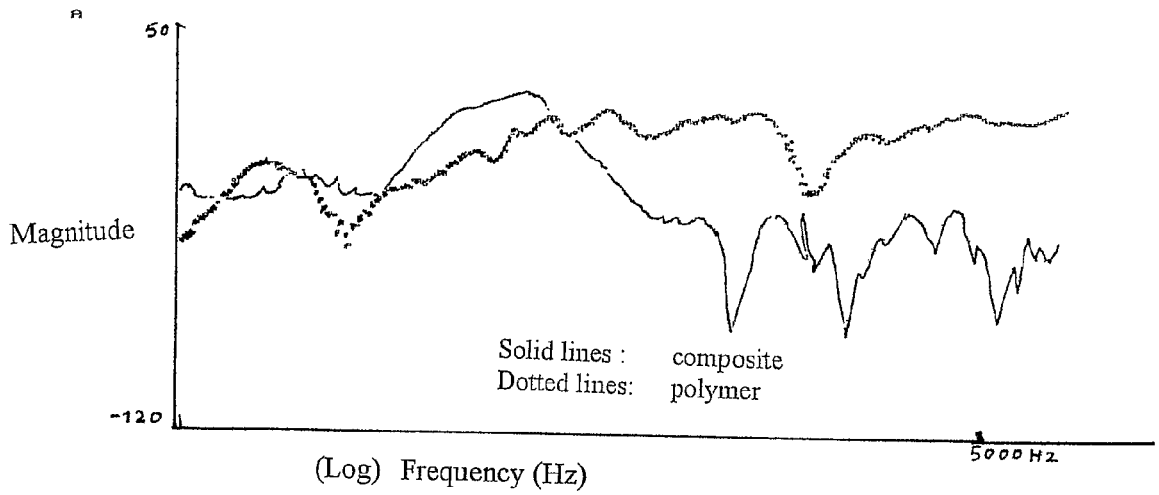
FIG. 8 is the plot of vibration attenuation of composite vs. polymer.

The test set up for examining the vibration attenuation of the structural composite is shown in FIG. 7. In each experiment, the test piece 10 is held horizontally as a cantilever beam by a rigid stand 20. The electrodynamic shaker 30 is attached to the test piece through a transducer 40. An accelerometer 50 is attached to the test piece as shown. The accelerometer output is connected to a Dynamic Signal Analyzer 60. The shaker is driven with a frequency sweep from 500 Hz to 5,000 Hz and the vibration acceleration of the strip is recorded as a plot of RMS velocity (in dB) against frequency. A pure polymer block of the same outer material and size is taken as a reference. Therefore, two plots are obtained in two experiments, as shown in FIG. 8. The recorded plots shown several modes of resonance peaks at various frequencies gives the vibration damping in dB due to the presence of the corrugated core, at the corresponding frequency. For example, the attenuation at 600 Hz is 7 dB, at 2000 Hz is 16 dB and at 5000 Hz is 20 dB.

As many different embodiments of the invention will occur to those proficient in the art, it is to be understood that the specific embodiments of the invention, as presented above, are intended by way of illustration only and not limiting on the invention, but that the limitations thereon are to be determined only from the appended claims.

REFERENCE PATENTS CITED

| | | | |
|---|---|---|---|
| WO 03/008494 | January 2003 | O. J. Rettenmaier | C08L1/00; C08L97/02 |
| JP 2002347009 | December 2002 | U. Yasushi | B27N1/01; C08K5/20 |
| RU 2186808 | August 2002 | A. P. Shalashov et al | C08L97/02; B27N3/00 |
| WO 02/26456 | April 2002 | B. Lipman | B27N7/00 |
| WO 99/55979 | November 1999 | D. A. Tingley | E04C1/00 |
| U.S. Pat. No. 5,433,156 | July 1995 | J. P. Hutchison | B65D19/00 |
| U.S. Pat. No. 5,364,178 | November 1994 | W. K. Hofman et al | A47B47/00 |
| U.S. Pat. No. 5,076,176 | December 1991 | H. A. Clasen | B65D19/00 |
| U.S. Pat. No. 5,057,176 | October 1991 | W. Bainbridge | B32B31/18; B32B31/20 |
| U.S. Pat. No. 4,837,999 | June 1999 | V. Stayner | E04C1/00 |
| U.S. Pat. No. 4,265,067 | May 1981 | F. I. Palmer | E04C2/20 |
| U.S. Pat. No. 3,629,046 | December 1971 | W. B. GUbert | B32B3/28 |

We claim:

1. A lightweight structural composite comprising an inner core of lightweight panel filled with rigid polymeric foam encapsulated by outer layers of polymer material and wherein the lightweight panel comprises 46 flutes per meter, forming a plurality of corrugated sheets secured together by rigid polymeric foam, an adhesive or combination thereof.

2. The lightweight structural composite as claimed in claim 1, wherein the rigid polymeric foam is formed in situ thus keeping the composite intact without distortion.

3. The lightweight structural composite as claimed in claim 1, wherein the inner core of lightweight panel filled with rigid polymeric foam is encapsulated with a thermosetting elastomer polymer blend, which can withstand a compressive load of 5 MPa.

4. The lightweight structural composite as claimed in claim 1, wherein the compression strain of 0.017 of the said composite is constant at 5 MPa and remained constant over a period of 24 hrs with no time dependent creep.

5. The lightweight structural composite as claimed in claim 1, comprising an inner core of lightweight panel filled with rigid polymeric foam encapsulated by outer layers of polymer material which can regain the shape and size after repeated compression load cycles up to a compressive stress of 5 MPa.

6. The lightweight structural composite as claimed in claim 1, wherein the composite showed a 5 to 20 dB reduction in vibration amplitude compared to solid polymer.

7. The lightweight structural composite as claimed in claim 1, wherein the said polymer material comprise a blend of a thermoplastic polymer an elastomer and a thermosetting resin.

* * * * *